United States Patent [19]

Ishii et al.

[11] Patent Number: 4,954,696

[45] **Date of Patent: * Sep. 4, 1990**

[54] SELF-REGULATING HEATING ARTICLE HAVING ELECTRODES DIRECTLY CONNECTED TO A PTC LAYER

[75] Inventors: Kazunori Ishii; Seishi Terakado, both of Nara; Yasutomo Funakoshi; Tadashi Sakairi, both of Osaka, all of Japan

[73] Assignee: Matsushita Electric Industrial Co., Ltd., Osaka, Japan

[ * ] Notice: The portion of the term of this patent subsequent to Nov. 8, 2005 has been disclaimed.

[21] Appl. No.: 190,562

[22] Filed: May 5, 1988

Related U.S. Application Data

[63] Continuation of Ser. No. 809,966, Dec. 17, 1985, Pat. No. 4,783,587.

[30] Foreign Application Priority Data

| | | | |
|---|---|---|---|
| Dec. 18, 1984 | [JP] | Japan | 59-266640 |
| Dec. 18, 1984 | [JP] | Japan | 59-266641 |
| Dec. 18, 1984 | [JP] | Japan | 59-266647 |
| Dec. 18, 1984 | [JP] | Japan | 59-266649 |
| Dec. 18, 1984 | [JP] | Japan | 59-266664 |
| Dec. 18, 1984 | [JP] | Japan | 59-266665 |
| Dec. 18, 1984 | [JP] | Japan | 59-266666 |
| Dec. 18, 1984 | [JP] | Japan | 59-266668 |
| Dec. 18, 1984 | [JP] | Japan | 59-266669 |
| Oct. 18, 1985 | [JP] | Japan | 60-233618 |

[51] Int. Cl.[5] ..... H05B 3/10

[52] U.S. Cl. ..... 219/548; 219/549; 338/22 R

[58] Field of Search ..... 219/548, 549, 552, 553, 219/528; 338/22 R, 225 D

[56] References Cited

U.S. PATENT DOCUMENTS

| | | | |
|---|---|---|---|
| 3,221,145 | 11/1965 | Hager, Jr. | 219/549 |
| 3,397,302 | 8/1968 | Hosford | 219/528 |
| 4,327,351 | 4/1982 | Walker | 338/22 R |
| 4,330,703 | 5/1982 | Horsma et al. | 338/22 R X |

FOREIGN PATENT DOCUMENTS

| | | |
|---|---|---|
| 0022611 | 1/1981 | European Pat. Off. . |
| 0026457 | 4/1981 | European Pat. Off. . |
| 0038714 | 10/1981 | European Pat. Off. . |

*Primary Examiner*—Bruce A. Reynolds
*Assistant Examiner*—Marvin Lateef
*Attorney, Agent, or Firm*—Pollock, Vande Sande & Priddy

[57] ABSTRACT

A self-regulating heating article includes a first elongate layer formed by a crystalline polymeric composition of high crystallinity and conductive particles dispersed in the polymeric composition to exhibit a positive temperature coefficient of resistance. A pair of elongate electrodes, which are adapted for connection to a power supply, are secured one on each surface of the first layer to develop a potential in the direction of thickness of the first layer. The electrodes are arranged so that a creeping distance which is greater than the thickness of the first layer is established between the electrodes along peripheral edges thereof. The creeping distance prevents insulation breakdown and ensures safe, high wattage operation at power supply voltages.

70 Claims, 8 Drawing Sheets

SELF-REGULATING HEATING ARTICLE HAVING ELECTRODES DIRECTLY CONNECTED TO A PTC LAYER

This is a continuation of application Ser. No. 809,966, filed on Dec. 17, 1985, now U.S. Pat. No. 4,783,587 issued Nov. 8, 1988.

BACKGROUND OF THE INVENTION

The present invention relates to a layered heating article formed of a material exhibiting a positive temperature coefficient of resistance.

The present invention related generally to heating elements, and more particularly to a self-regulating heating article which utilizes a meterial exhibiting positive temperature coefficient (PTC) of resistance.

The distinguishing charcteristic of PTC materials is that on reaching a certain temperature (switching temperature), a sharp rise in resistance occurs and the heating article utilizing such materials switches off.

There exists a need for flexible strip heaters with high power output densities and/or higher operating temperatures. One approach to electrical heating appliances involves forming a PTC material into a two-dimensional sheet and attaching to it a pair of strip electrodes, one at each end of the PTC sheet. The actual wattage delivered by such prior art heater is far less than that which would be expected because the heat is produced in a very thin band between the strip electrodes. Such a phenomenon, which is termed "hotline" by Horsma et al in U.S. Pat. No. 4,177,376, results in an inadequate heating performance and renders the heating appliance useless where high wattage outputs and/or temperatures above 100° C. are desired. The aforesaid United States patent avoids this hotline problem by interposing a constant wattage (CW) layer between a PTC layer and an electrode.

It is still desired that the thermal resistance between electrodes be as small as possible for more efficient operation. Improvement in the manufacture of PTC heating appliances is further desired for cost reduction.

SUMMARY OF THE INVENTION

It is therefore a primary object of the present invention to provide an efficient high-wattage level PTC heating article.

This object is attained by a self-regulating heating article which comprises a first elongate layer comprising a crystalline polymeric composition of high crystallinity and conductive particles dispersed in the polymeric composition to exhibit a positive temperature coefficient of resistance. A pair of elongate electrodes, which are adapted for connection to a power supply is secured one on each surface of the first layer to develop a potential in the direction of thickness of the first layer. The electrodes are arranged so that a creeping distance which is greater than the thickness of the first layer is established between the electrodes along peripheral edges thereof. The creeping distance prevents insulation breakdown and ensures safe, high wattage operation at mains supply voltages.

Because of the simplified laminated structure, a substantial improvement in productivity can be achieved.

BRIEF DESCRIPTION OF THE DRAWINGS

Further features and advantages of the present invention will be described with reference to the accompanying drawings, in which.

DETAILED DESCRIPTION

Figure 1:
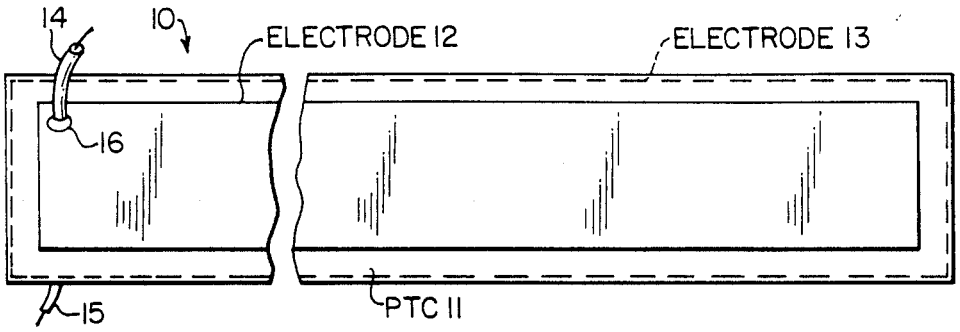
FIG. 1 is a plan view of a self-regulating heating article according to a first embodiment of the invention.
Figure 2:
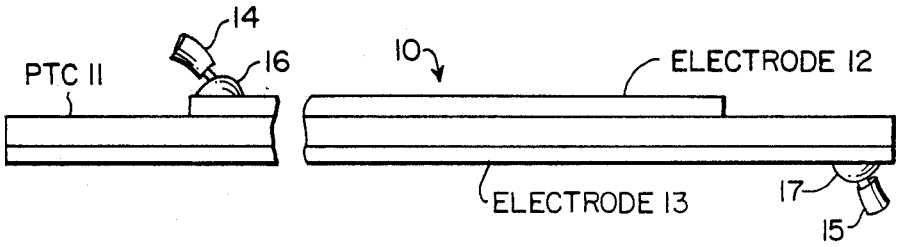
FIG. 2 is an end view of the first embodiment.

Referring now to FIGS. 1 and 2, there is shown a layered self-regulating heating article 10 according to an embodiment of the present invention in the form of a 300-mm long and 10-mm wide strip. Heating strip 10 has such a thickness that it can flex to adopt the shape of an article to be heated. As will be later described, heating strip 10 may be sandwiched between metal plates for space heating.

Heating strip 10 comprises a resistance layer 11 of material having a positive temperature coefficient (PTC) of resistance. PTC resistance layer 11 is sandwiched between an upper conductive layer or electrode 12 and a lower conductive layer or electrode 13 which is indicated by a dotted line in FIG. 1. Electrodes 12 and 13 are adapted for connection to power supply, which is typically in the range between 100 and 200 volts, through lead wires 14, 15 connected by soldered joints as at 16 and 17, respectively. Upper layer 12 is offset inwardly by 2.5 mm along all the edges thereof from the peripheral edges of the PTC layer 11 to provide a sufficient "creeping distance" of 2.8 mm between the electrodes 12 and 13 to ensure electrical isulation. The creeping distance is the shortest distance along which current would seek a low impedance path which might exist between the electrodes when potential is applied there across. Experiments showed that resistance layer 11 having a thickness smaller than 3 mm, preferably 1 mm or less, and a thermal resistance of 0.02 $m^2h°C/Kcal$, gives high wattage levels with uniform heat distributions. In the illustrated embodiment the thickness of PTC resistance layer 11 is 0.3 mm.

Resistance layer 11 is formed of a resin of high crystallinity capable of withstanding high potentials and 30 weight-percent of carbon black particles having a substantially spherical shape with an average size of more than 0.05 micrometer, typically 0.1 micrometer, uniformly dispersed in substantial contact with one another. The carbon black particles form conductive networks through the resin matrix to establish an initially low resistivity at lower temperatures. At about the crystalline melt point, the resin's matrix rapidly expands, causing a breakup of many of the conductive networks due to the difference in thermal expansion between the two materials, which in turn results in a sharp increase in the resistance of the composition to a resistivity which is $10^4$ to $10^6$ times higher than the room temperature value.

The resin suitable for the present invention has a high degreee of crystallization, typically 20 percent or more, according to X-ray analysis. Suitable materials for the resin include polyolefins such as ethylene-vinyl acetate copolymers, ethylene-ethyl acrylate copolymers, ionomer polyethylene, polypropylene as the like, and crystalline resins such as polyamides, halogenated vinylidene resins, polyesters and the like. Crosslinking agent or filler may be added to avoid deformation of the PTC element and to keep it from exhibiting a negative temperature characteristic. Coupling agent may also be added or graft polymerization may be provided to enhance the bond between the particulate carbon and resin matrix. With such additional agents or process, the PTC element can be made to exhibit a sharper increase in resistivity which is $10^9$ times higher than the room temperature resistivity. When an AC potential of 100 volts was applied, the heating article 10 showed an initial wattage of 6 watts/cm$^2$ and levelled off to a steady value of 2 watts/cm$^2$. A temperature gradient of lower than 3 ° C. was observed between the electrodes 12 and 13, and a temperature of as high as 100° C. was obtained on both sides of the strip 10. The fact that the temperature gradient is 3° C. indicates that no "hotline" problem takes place. For testing purposes, the heating article was impressed with AC potentials of 200 volts, 250 volts, 300 volts and finally 500 volts, in succession, but abnormal leakage current was not observed.

Resistance layer 11 is made by a long strip of the PTC material mentioned above using an extrusion molding process and continuously cemented to long conductive strips on opposite sides by thermosetting or using a conductive adhesive agent to provide an elongate metal-backed structure. The latter is then cut into segments of desired length, typically 300 mm intervals, as mentioned above.

Figure 3:
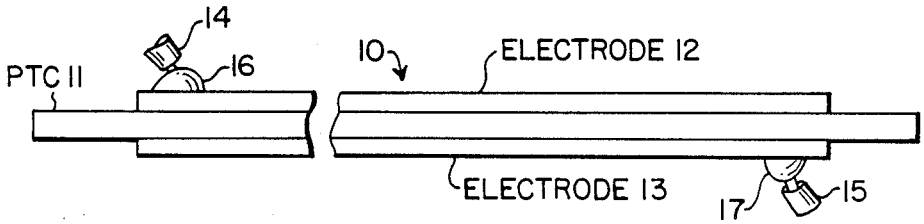
FIGS. 3 and 4 are end views of modified embodiments of the invention.
Figure 4:
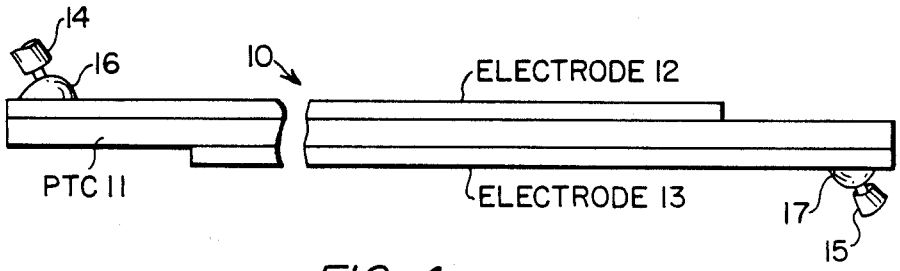

Modifications are possible to provide the necessary creeping distance as shown in FIGS. 3 and 4.

In FIG. 3, the upper and lower electrodes 12, 13 are offset by 1.5 mm on all their edges from the peripheral edges of the 0.3-mm thick PTC layer 11. The creeping distance of this embodiment is 3.3 mm. It is obvious that the electrodes are not necessarily centered with respect to the PTC strip 11 insofar as the creeping distance is ensured.

In FIG. 4, the upper and lower electrodes 12, 13 are offset by 2.5 mm from the right and left longitudinal edges of the 0.3 mm thick PTC layer 11, respectively, to give a creeping distance of 2.8 mm. This embodiment is preferred in favor of the previous embodiments in that the longitudinal edges of the PTC strip 11 are reenforced by the backing conductive layer; and conductive strips of the same width can be used for the electrodes.

Figure 5:
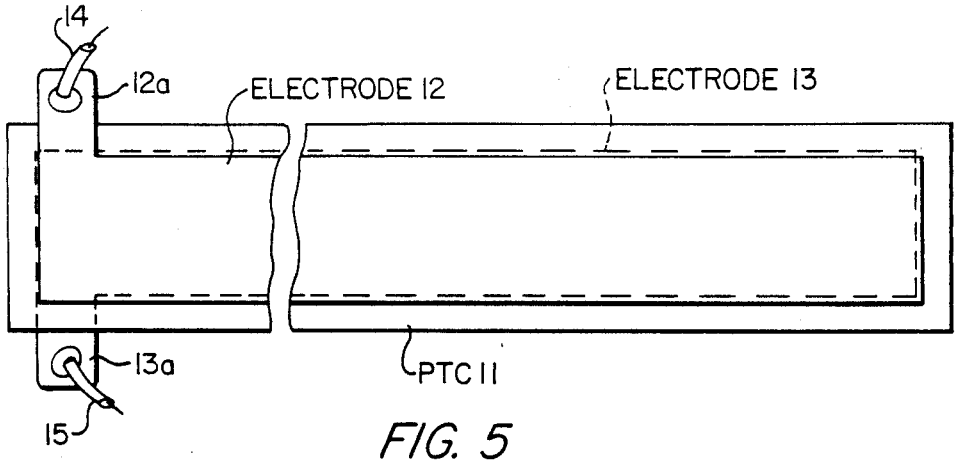
FIGS. 5 to 7 are plan views of further modifications of the invention.

For manufacturing purposes, it is advantageous to perform soldering on the same side of the article 10. FIG. 5 is an illustration of an embodiment suitable for this purpose. Electrodes 12 and 13 are provided respectively with lateral projections 12*a* and 13*a* extending laterally in opposite directions to each other to present a surface sufficient for the soldering operation and to permit the soldering machine to be accessed thereto in the same direction. Since soldering material tends to be heated by a current passing through it and since the lateral projections 12*a* and 13*a* are not in thermal contact with the PTC layer 11, the latter is protected from excessive heat developed in the soldered contact portions.

The problem associated with soldering can also be avoided by arrangements shown in FIGS. 6 to 10.

Figure 6:
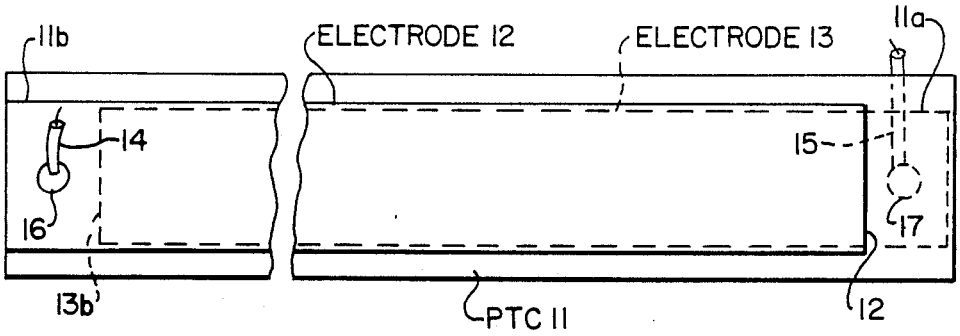

In FIG. 6, the upper electrode 12 is offset at its right-end edge 12*b* and the lower electrode 13 is offset at its left-end edge 13*b* to expose the PTC layer 11 at end portions 11*a* and 11*b*. Lead wire 14 is soldered on a portion of the upper electrode 12 which is overlying the exposed portion 11*b* of the PTC layer 11 and lead wire 15 is soldered on a portion of the lower electrode 13 which is underlying the exposed portion 11*a* of the PTC layer 11. If the soldered joints 16 and 17 are heated excessively and the desired characteristics of the PTC layer are destroyed at portions 11*a* and 11*b* to the detriment of their insulation, such insulation failure will be confined to localized areas and shorting between electrodes 12 and 13 through the failed part of the PTC layer can be avoided due to the absence of an adjacent counterelectrode.

Figure 7:
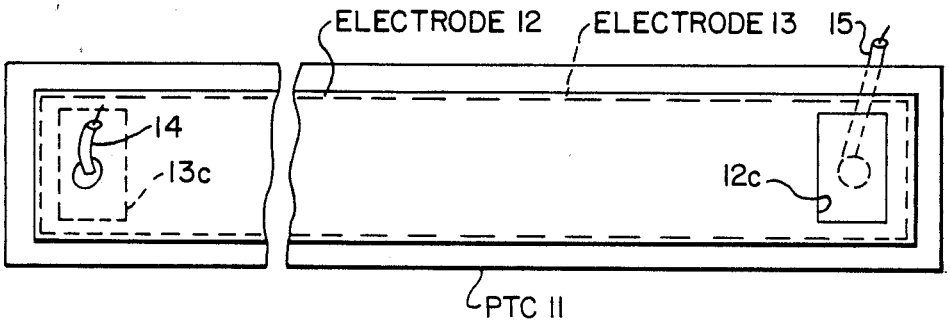

Alternatively, in FIG. 7, the upper and lower electrodes 12, 13 are formed with windows 12*c* and 13*c*, respectively, in positions adjacent the left-and right-end edges of the heating strip 10. Lead wire 14 is soldered in the portion of the electrode 12, below which the window 13*c* if formed and lead wire 15 is soldered in the portion of the electrode 13 above which the window 12*c* is provided.

Figure 8:
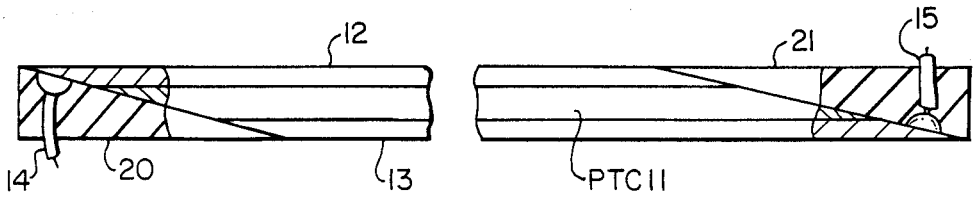
FIGS. 8 to 10 are side views of still further modifications of the invention.
Figure 9:
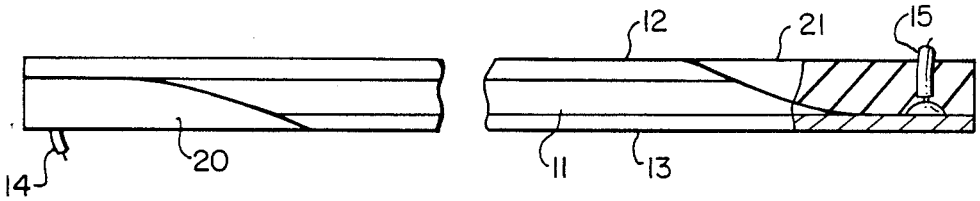
Figure 10:
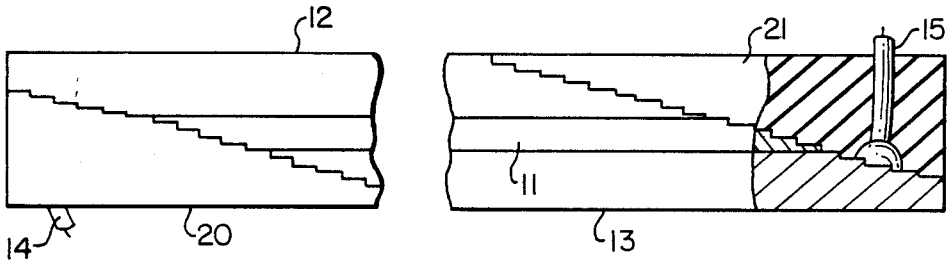

The individual heating segments have sufficient creeping distance with respect to their longitudinal edges. However, if the cut angle is perpendicular to the surface of the workpiece, the creeping distance is not sufficient with respect to the edges at each end thereor. FIGS. 8 to 10 illustrate embodiments having bevelled edges at opposite ends to provide the necessary creeping distance in efficient manner.

In FIG. 8, each end of the strip 10 having a 0.5-mm thick PTC layer 11 has a bevelled edge inclined at an angle, typically at 11 degrees, to the length thereof to provide a creeping distance of 2.6 mm, for example. Lead wires 14 and 15 are soldered to the bevelled surfaces of electrodes 12 and 13, respectively, and insulating thermosetting material is molded on the bevelled edges as shown at 20 and 21 to conceal the soldered portions. The bevelled surface can be formed by tilting the cut angle when the long composite strip is cut into the individual segments. The creeping distance can be lengthened by forming curved surfaces as shown at FIG. 9 to increase the creeping distances. Instead of the curved surfaces, each end of the segmented strip may be formed into the shape of a staircase using a milling machine as shown in FIG. 10. The creeping distance is, of course, determined by the steps formed in the PTC layer 11.

Embodiments shown in FIGS. 11 to 15 provide the necessary creeping distance at opposite ends of the segmented heating strip with the cut angle being maintained at 90 degrees to the length of the strip.

Figure 11:
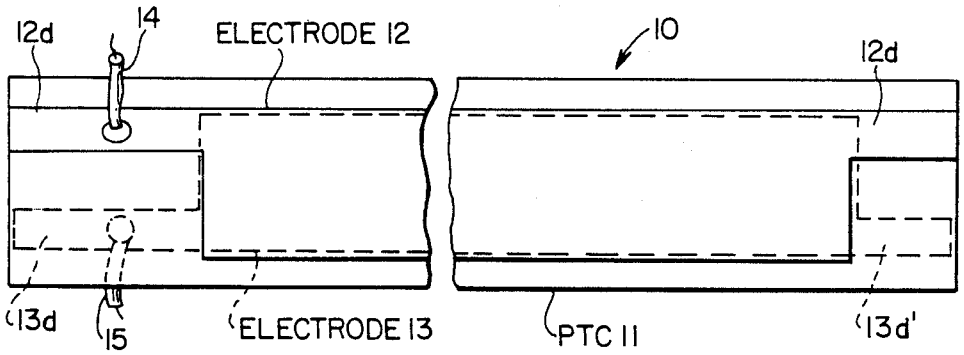
FIG. 11 is a plan view of a modified embodiment useful for efficient manufacture.
Figure 12:
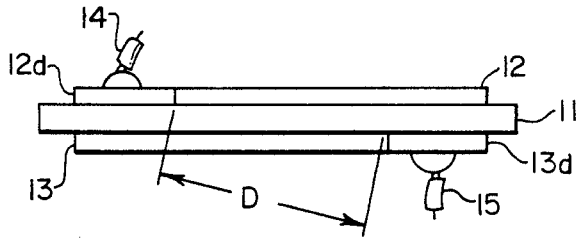
FIG. 12 is an end view of the modification.
Figure 13:
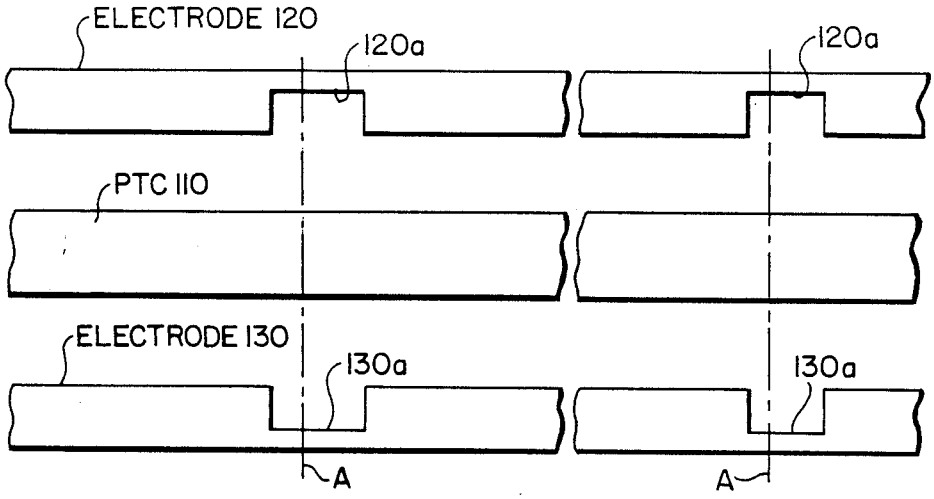
FIG. 13 is an illustration useful for describing the method by which the heating articles of FIG. 11 are manufactured.

Electrode 12 of the FIG. 11 embodiment has a narrow end portion 12*d* at the left end and narrow end portion 12*d*' at the right end which is one-half the length of the portion 12*d*. Similarly, electrode 13 has a narrow end portion 13*d*at the left end and a narrow end portion 13*d*' at the right end, the portions 13*d* and 13*d*' being displaced transversely from the end portions 12*d* and 12*d*', respectively. Lead wires 14 and 15 are soldered to the longer end portions 12*d*and 13*d*, respectively. The creeping distance D at each end of the article 10 is measured between the end portions 12*d*and 13*d* as shown in FIG. 12. As shown in FIG. 13, the FIG. 11 embodiment is fabricated by preparing a long strip of conductor 120 having cutout portions 120*a* formed at longitudinal intervals and a second long strip of conductor 130 having similar cutout portions 130*a*. Conductors 120 and 130 are cemented on the opposite sides of a PTC strip 110 so that cutout portions 120*a* and 130*a* are aligned longitudinally with each other but not aligned transversely with each other. The layered structure is then cut at right angles thereto along chain-dot lines A which lie at one-third of the length of the cutouts.

Figure 14:
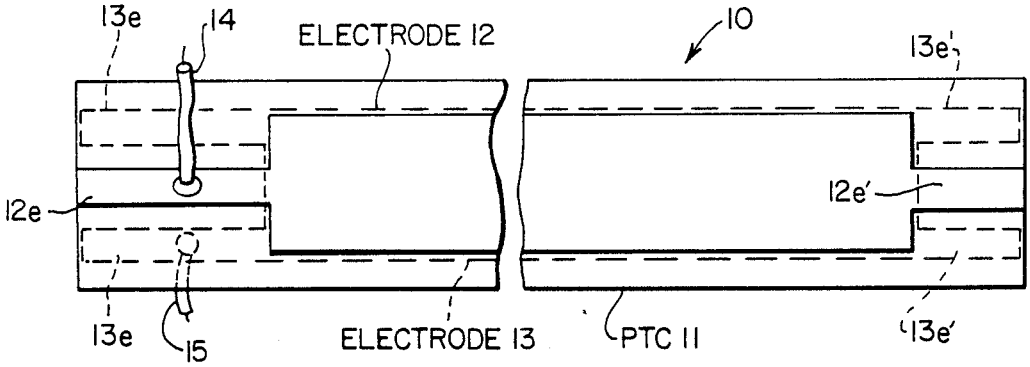
FIG. 14 is a plan view of an alternative form of the FIG. 11 embodiment.
Figure 15:
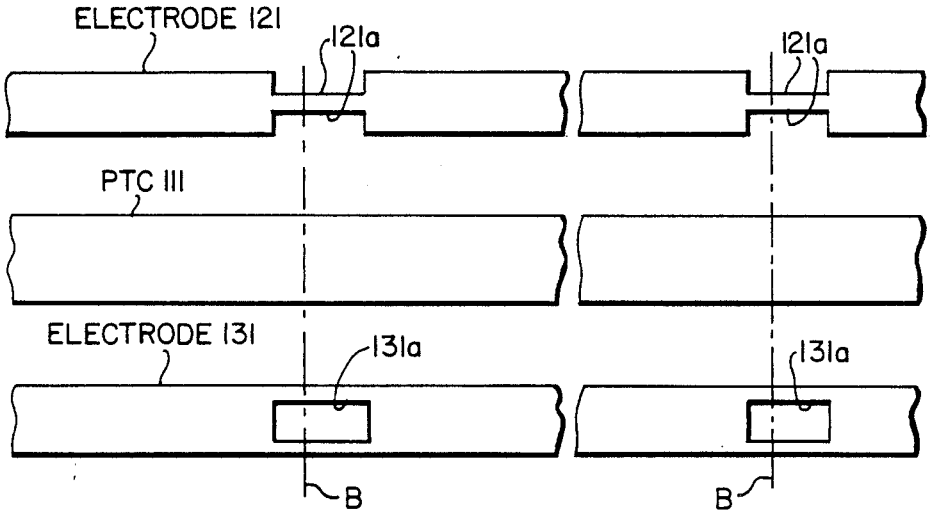
FIG. 15 is an illustration useful for describing the method by which the heating articles of FIG. 14 are manufactured.

Alternatively, the electrode 12 of the embodiment of FIG. 14 has a narrow end portion 12*e* at the left end and a narrow end portion 12*e*' at the right end, which is one-half the length of the end portion 12*e*. Electrode 13 has a pair of transversely spaced narrow end portions 13*e* at the left end and a pair of transversely space narrow end portions 13*e*' at the right end. End portions 12*e* and 12*e*' are not aligned with the end portions 13*e* and 13*e*' to provide the necessary creeping distance. The FIG. 14 embodiment is fabricated by preparing a long strip of conductor 121 as shown in FIG. 15 with a plurality of pairs of transversely spaced cutout portions 121*a* at longitudinal intervals and a long strip of conductor 131 having a plurality of rectangular cutouts 131*a* and cementing the conductors onto a PTC strip 111. The layered structure is cut into segments along lines B which lie at one-third of the length of the cutout 121*a*.

Because of the laterally displaced location of the narrow end portions, the embodiments of FIGS. 11 and 14 are also protected from insulation breakdown which might occur as a result of excessive heat generated by soldered joints in a manner identical to the embodiments of FIGS. 6 and 7.

Figure 16:
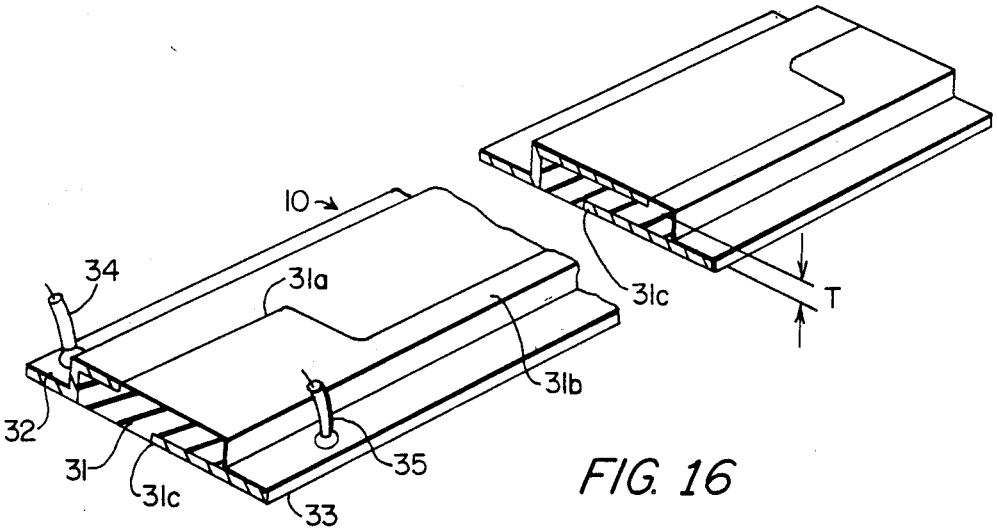
FIG. 16 is a perspective view of a modified form of the FIG. 11 embodiment with an illustration of a transverse cross-section.

FIG. 16 is a modification of the FIG. 11 embodiment. In this modification, heating article 10 is formed by a PTC layer 31 having a shallow recess 31*a* on the upper surface thereof with the boundary between it and the land portion 31*b* following a curve generally similar to the contour line of the electrode 12 of FIG. 11. Upper electrode 32 has a contour line identical to the contour line of the recess 31*a* and a stepped portion along the longitudinal straight edge. The upper portion of electrode 32 is cemented to the recess 31*a* of PTC layer 31 and the stepped portion to a longitudinal edge thereof, so that the upper surface of electrode 32 and the land portion 31*b* of PTC layer 31 are even with each other concealing the edge of electrode 32 in the recess and the flange portion of electrode 32 made flush with the lower surface of PTC layer 31. PTC layer 31 is further formed with a recess 31*c* on the lower surface thereof. Lower electrode 33 is cemented to the recess 31*c* presenting a flat surface with the PTC layer 31 so that a portion of the electrode 33 forms a flange on the opposite side to the flange of upper electrode 32. Lead wires 34 and 35 are attached to the flanges of electrodes 32 and 33, respectively. The boundary where each of the electrodes 32, 33 meets with the adjoining surface is spaced from the opposite electrode at a distance which is at least equal to the creeping distance which in turn is greater than the thickness T of the portion of PTC layer 31 where upper and lower electrodes 32, 33 overlap.

Figure 17:
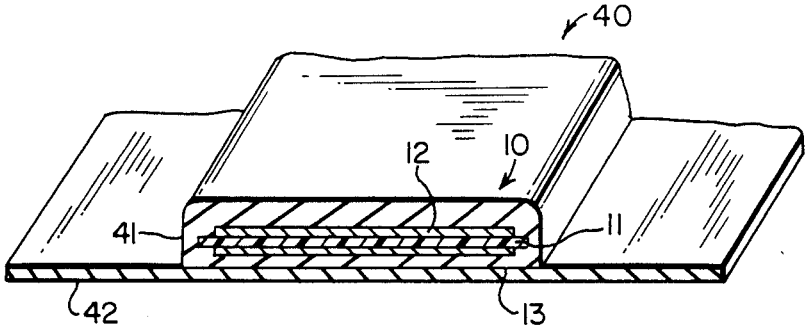
FIGS. 17 to 21 are perspective views of various embodiments each having an insulative enclosure.

FIG. 17 shows an insulated heating article 40 which comprises the metal-backed heating strip 10 enclosed with a polyvinylchloride layer 41 and cemented to a base 42 having a larger flexural rigidity than layer 41 to enable it to be worked with ease. Article 40 is attached to an object to be heated with the base 42 being in contact with the object. Enclosure 41 serves to confine heat generated by PTC layer 11 and base 42 serves as an energy diffusion surface to uniformly transfer the confined energy to the object being heated.

Figure 18:
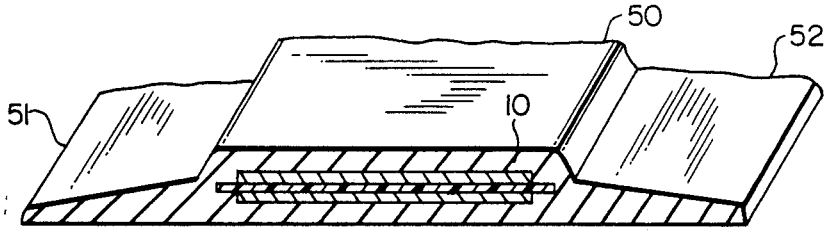

The heating article 10 may be enclosed in a mold as shown at 50 in FIG. 18. The mold 50 is shaped to form a pair of flanges 51, 52 which are outwardly tapered in thickners. The mode presents a sufficient contact surface with an object to be heated for efficient heat diffusion and transfer.

Figure 19:
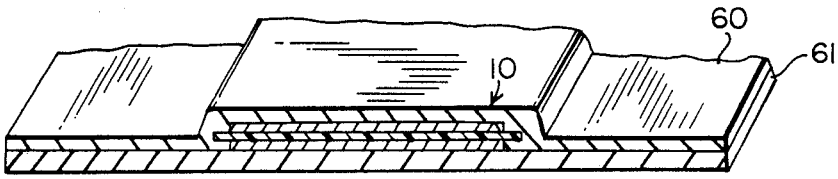

In FIG. 19, metal-backed strip 10 is sandwiched between resin films 60 and 61. Film 61 has a thickness 1.5 times greater than the thickness of film 60 and a flexural rigidity three times greater than that of film 60. Films 60 and 61 extend laterally and are cemented together to form a thin laminated structure. High rigidity inorganic material such as mica can also be used for film 60.

Figure 20:
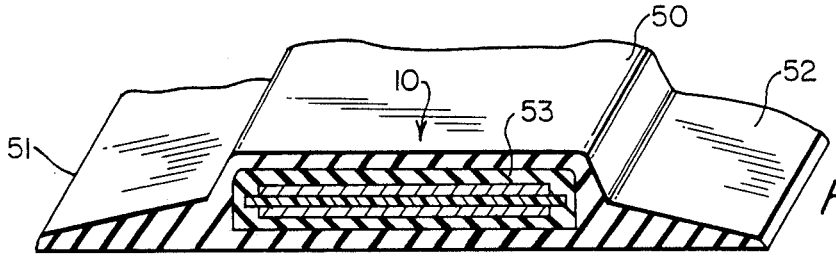
Figure 21:
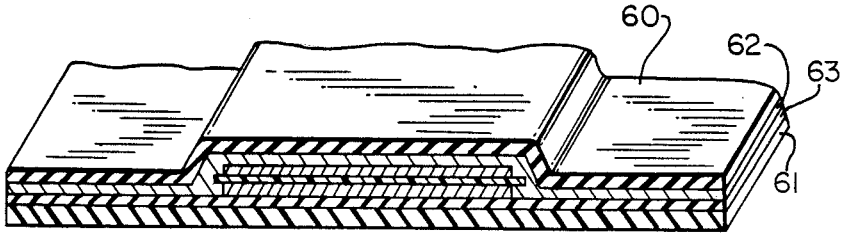

An embodiment shown in FIG. 20 is similar to the FIG. 18 embodiment with the exception that it includes a thermally fused layer 53 interposed between the metal-backed strip 10 and the surrounding polyvinylchloride mold 50. Fusable layer 53 is formed of a resin having a lower melting point than mold 50 to serve as a cushion for working the molded heating article. This layer 53 also functions as a filler to fill in any interstices which might exist to reduce the thermal resistance. Such fusable material can also be employed as shown in FIG. 21 as a modification of FIG. 19 by forming fused films 62 and 63 between layers 60 and 61. This structure permits the films 60 and 61 to be formed by an extrusion process.

For space heating application each of the previous embodiments is used as many times as desired and arranged side by side on a large metal sheet.

Figure 22:
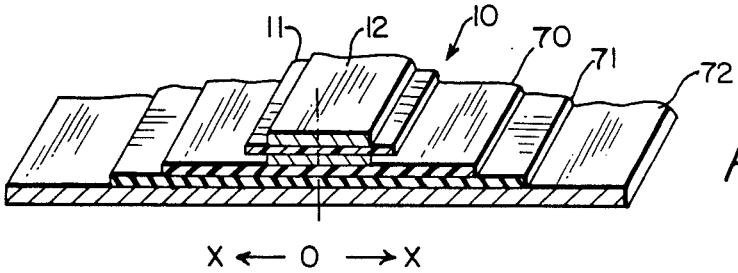
FIG. 22 is a perspective view of a preferred embodiment having a heat diffusion layer.
Figure 23:
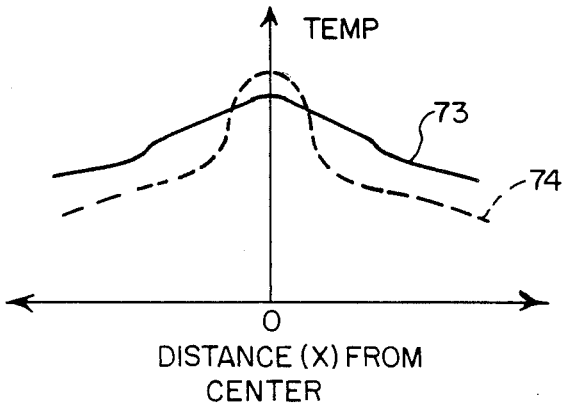
FIG. 23 is a graphic illustration associated with the embodiment of FIG. 22, and FIGS. 24 to 26 are perspective views of panel heaters incorporating the present invention.

In FIG. 22, metal-backed PTC strip 10 is in contact with a highly conductive layer 70 having a larger surface than strip 10. Layer 70 is formed of a material such as aluminum, copper or iron to provide a heat diffusion function and is cemented to an insulating layer 71 having low thermal conductivity and a larger area than layer 70. Insulating plate 71 is secured to a heat radiation metal sheet 72 having a larger area than insulating plate 71. Heat generated by the PTC article 10 diffuses in all directions by conductive layer 70 and is conducted through insulating member 71 to the radiating surface 72. By the interposition of insulating layer 71, thermal energy is conducted to the radiating surface 72 with a minimum of loss. As indicated by a solid-line curve 73 in FIG. 23, the provision of the conductive layer 70 serves to distribute thermal energy uniformly over the surface of the radiating sheet 72 is favorably compared with the heat distribution which is obtained without the heat diffusion layer 70 as indicated by a broken-line curve 74. More specifically, the temperature is raised by 3° C. on the average, although there is a decreas at the center by 2° C. As a result, the heat radiating surface 72 is heated to a temperature approaching the self-regulating point of the PTC layer 11. A space heater having a large heat dissipation area can be accomplished by this embodiment.

Figure 24:
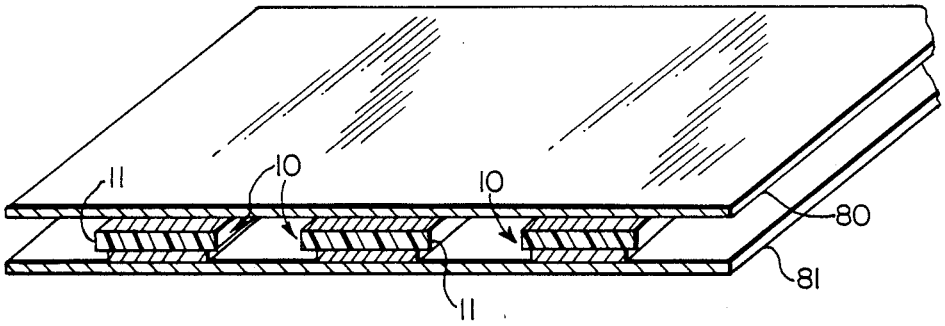
Figure 25:
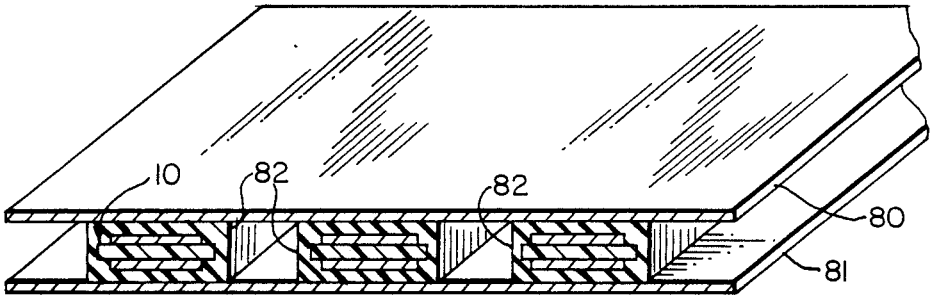

FIG. 24 is an illustration of a space heater employing a plurality of metal-backed heating articles 10 each having a 1-mm thick PTC layer. Articles 10 are arranged side by side between opposed aluminum heat radiation metal sheets 80 and 81. An interesting feature of this embodiment is that temperature difference measured across the opposite surfaces of the PTC layer 11 was one-fourth of the value which was obtained when one of the metal sheets 80, 81 was dispensed with. This means that for an apparatus having a pair of opposed heat radiating surfaces, the amount of thermal energy withdrawn from the PTC elements is four times greater than is possible with an apparatus having a single heat rediation surface. To provide insulation between radiation surfaces 80 and 81, each of the metal-backed articles 10 is enclosed by an insulating layer 82 as shown in FIG. 25. This insulation is prefered to coating the radiating surfaces with an insulating film.

Figure 26:
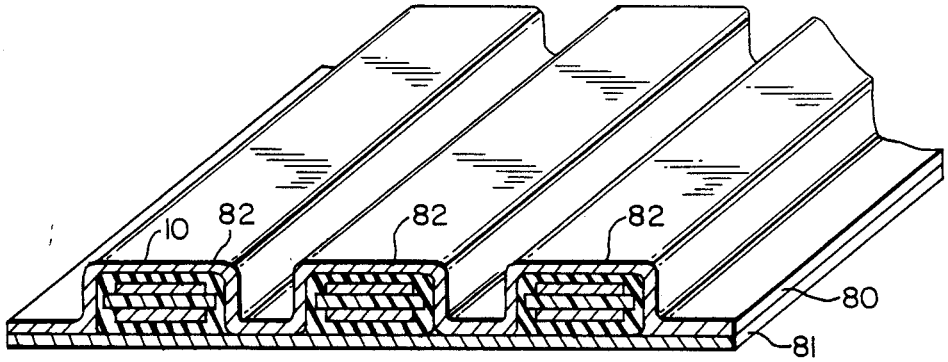

The embodiment of FIG. 25 is modified as shown in FIG. 26 in which the radiating surface 80 is formed into a corrugated shape to make contact with the opposite radiating surface 81. With this corrugation, any temperature difference which might develop between surfaces 80 and 81 can be uniformly distributed between them.

The foregoing description show preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A self-regulating heating article comprising:

a first conductive elongate layer comprising a crystalline polymeric composition of high crystallinity and conductive particles dispersed in said polymeric composition to exhibit a positive temperature coefficient of resistance, the first layer having a thickness of 1 millimeter or less; and a pair of second conductive elongate layers adapted for connection to a power supply, said second layers being metallic and secured one on each surface of said first layer to develop a potential in the direction of thickness of the first layer and to effect an effective exothermic portion at said first layer where said pair of second layers overlaps, said second layers having a creeping distance therebetween along peripheral edges, said creeping distance being greater than the thickness of said first layer.

2. A self-regulating heating article as claimed in claim 1, wherein one of said second layers has a transverse dimension smaller than a transverse dimension of said first layer and has longitudinally extending peripheral edges thereof inwardly offset from adjacent longitudinally extending peripheral edges of said first layer, and the other second layer has a transverse dimension equal to the transverse dimension of the first layer and has longitudinally extending peripheral edges thereof flush with said peripheral edges of said first layer.

3. A self-regulating heating article as claimed in claim 1, wherein said second layers have transverse dimensions equal to each other but smaller than the transverse dimension of said first layer, each of said second layers having longitudinally extending peripheral edges thereof offset inwardly from adjacent longitudinally extending peripheral edges of said first layer.

4. A self-regulating heating article as claimed in claim 1, wherein said second layers have transverse dimensions equal to each other but smaller than the transverse dimension of said first layer, one of said second layers having a longitudinally extending peripheral edge thereof inwardly offset from a longitudinally extending peripheral edge of the first layer and the other second layer having a longitudinally extending peripheral edge thereof inwardly offset from an opposite longitudinally extending peripheral edge of the first layer.

5. A self-regulating heating article as claimed in claim 1, wherein each of said second layers has a projection, further comprising means for coupling said projection to said power supply.

6. A self-regulating heating article as claimed in claim 1, wherein one of said second layers has a transversely extending peripheral edge thereof offset inwardly from an adjacent transversely extending peripheral edge of said first layer and the other second layer has a transversely extending peripheral edge thereof offset inwardly from an opposite transversely extending peripheral edge of said first layer, further comprising means for coupling said second layers to said power supply from portions adjacent to the transversely extending peripheral edges thereof which are opposite to the inwardly offset transversely extending peripheral edges of the respective second layers.

7. A self-regulating heating article as claimed in claim 1, wherein one of said second layer has a cutout portion adjacent a transversely extending peripheral edge thereof and the other second layer has a cutout portion adjacent a transversely extending peripheral edge thereof which is opposite to said transversely extending peripheral edge of said one of the second layers, further comprising means for coupling said second layers to said power supply from portions adjacent the transversely extending peripheral edges thereof which are opposite said cutout portions.

8. A self-regulating heating article as claimed in claim 1, wherein each of said second layers has a portion connectable to said power supply, said portion of each of said second layers being displaced in a transverse direction from the corresponding portion of the other second layer.

9. A self-regulating heating article as claimed in claim 1, wherein the transversely extending peripheral edges of said first layer and second layers are inclined to boundary surfaces between said first and second layers, further comprising means connected to the inclined edges of said second layers for connecting said second layers to said power supply.

10. A self-regulating heating article as claimed in claim 9, further comprising an insulating mold attached to each inclined edge of said first and second layers.

11. A self-regulating heating article as claimed in claim 9, wherein each of said inclined edges has a curved surface.

12. A self-regulating heating article as claimed in claim 9, wherein each of said inclined edges has a staircase profile.

13. A self-regulating heating article as claimed in claim 1, wherein each of said second layers has a portion longitudinally extending from a transversely extending peripheral edge thereof, said longitudinally extending portion of each of said second layers being transversely spaced from the longitudinally extending portion of the other second layer.

14. A self-regulating heating article as claimed in claim 1, wherein one of said second layers has a portion longitudinally extending from a transversely extending peripheral edge thereof, and the other second layer has a pair of portions longitudinally extending from a transversely extending peripheral edge thereof, said longitudinally extending portion of said one second layer being spaced transversely from the longitudinally extending portions of the other second layer.

15. A self-regulating heating article as claimed in claim 13, wherein said first layer has a recess on each surface thereof, said second layers being secured in said recesses.

16. A self-regulating heating article as claimed in claim 1, further comprising an insulative layer enclosing said first layer and second layers.

17. A self-regulating heating article as claimed in claim 1, further comprising a flexible layer secured to one of said second layers, said flexible layer having a transverse dimension greater than a transverse dimension of said second layers.

18. A self-regulating heating article as claimed in claim 1, further comprising a thermally fused layer attached to one of said second layers and a flexible layer attached to said thermally fused layer, said flexible layer having a transverse dimension greater than a transverse dimension of said second layers.

19. A self-regulating heating article as claimed in claim 1, further comprising a thermal diffusion layer attached to one of said second layers, said thermal diffusion layer having a transverse dimension greater than a transverse dimension of said first layer.

20. A self-regulating heating article as claimed in claim 19, further comprising a heat radiation layer in thermal transfer contact with said thermal diffusion layer, said heat radiation layer having a transverse dimension greater than the transverse dimension of said thermal diffusion layer.

21. A self-regulating heating article as claimed in claim 1, further comprising a base having a transverse dimension greater than a transverse dimension of said second layers, said base being in thermal transfer contact with one of said second layers, and a third, insulating layer overlying the other second layer, the third layer having the same transverse dimension as said base and attached thereto alongside thereof, said base having a rigidity greater than said third layer.

22. A self-regulating heating article as claimed in claim 1, further comprising a heat radiation panel secured in thermal transfer contact to one of said second layers.

23. A self-regulating heating article as claimed in claim 22, further comprising a second heat radiation panel secured in thermal transfer contact to the other of said second layers.

24. A self-regulating heating article as claimed in claim 1, further comprising insulative means interposed between one of said second layers and a panel and between the other second layer and a second panel.

25. A self-regulating heating article as claimed in claim 24, wherein said panels are in thermal transfer contact with each other.

26. A self-regulating heating article as claimed in claim 1, wherein said conductive particles comprise carbon black.

27. A heating appliance comprising:

a heat radiation panel having a two-dimensional surface; and a plurality of heating strips arranged side by side on said panel in heat transfer relationship therewith, each of said strips comprising:

a first conductive elongate layer comprising a crystalline polymeric composition of high crystallinity having a positive temperature coefficient of resistance and conductive particles dispersed in said polymeric composition, said first layer having a thickness of 1 millimeter or less; and a pair of second conductive elongate layers adapted for connection to a power supply, said second layers being metallic and secured one on each surface of said first layer to develop a potential in the direction of thickness of the first layer and to effect an effective exothermic portion at said first layer where said pair of second layers overlaps, said second layers having a creeping distance therebetween along peripheral edges, said creeping distance being greater than the thickness of said first layer, one of said second layers being in said heat transfer relation with said panel.

28. A heating appliance as claimed in claim 27, further comprising a second heat radiation panel in heat transfer relationship with the other second layer of each of said heating strips.

29. A heating appliance as claimed in claim 28, further comprising means for insulating each of said heating strips with said panels.

30. A heating appliance as claimed in claim 29, wherein one of said panels is in heat transfer contact with the other in areas unoccupied by said heating strips.

31. A self-regulating heating article comprising:

(a) a thin plate-like resistive layer comprising mainly a mixture of a crystalline polymeric composition of high crystallinity and high breakdown voltage conductive particles having stability so that a commercial voltage may be applied in the direction of thickness of said resistive layer, and dispersed in said crystalline polymeric composition, said resistive layer being formed to a thin elongate shape by heating to melt and exhibiting a positive temperature coefficient of resistance, said resistive layer having a thickness of 1 millimeter (mm) or less; and (b) a pair of laminar metal electrode layers, said pair of electrode layers being secured one on each surface of said resistive layer such that an electric current flows in the direction of thickness of said resistive layer, that a distance between said electrode layers is 1 mm or less at an effective exothermic portion of said resistive layer, that a creeping distance between said electrode layers is more than 1 mm at longitudinally extending peripheral edges, that said resistive layer protrudes outwardly beyond said electrode layers overlapped in the direction of thickness of said resistive layer along the entire peripheral edges of said resistive layer, that at least one of said electrode layers is offset from a longitudinally extending peripheral edge of said resistive layer, that at least one of said electrode layers is offset from an opposite longitudinally extending peripheral edge of said resistive layer, and that said effective exothermic portion on which said electrode layers are overlapped in the direction of thickness is covered with said electrode layers.

32. A self-regulating heating article as claimed in claim 31, wherein an end face portion of at least one of longitudinally extending peripheral portions of said resistive layer is covered with an electrode.

33. A self-regulating heating article as claimed in claim 31, wherein an end face portion of at least one of longitudinally extending peripheral portions of each of said electrode layers is embedded in said resistive layer.

34. A self-regulating heating article as claimed in claim 32, wherein an end face portion of at least one of longitudinally extending peripheral portion of each of said electrode layers is embedded in said resistive layer.

35. A self-regulating heating article as claimed in claim 31, wherein at least one of transverse extending end portions of said electrode layers has a shape and is positioned such that a portion of one of said electrode layers is displaced from a portion of said other electrode layer.

36. A self-regulating heating article as claimed in claim 35, wherein one of said electrode layers has a cut portion transversely extending from a longitudinal extending peripheral edge thereof and the other electrode layer has a cut portion transversely extending from a longitudinal extending peripheral edge which is opposite to said longitudinal extending peripheral edge of said one of said electrode layers, a remaining portion corresponding to said cut portion of said one electrode layer being displaced transversely from a remaining portion corresponding to said cut portion of said other electrode layer.

37. A self-regulating heating article as claimed in claim 35, wherein one of said electrode layers has a cut portion longitudinally extending from a central portion of a transverse extending peripheral edge thereof, and the other electrode layer has a pair of cut portions longitudinally extending from both end portions of said transversely extending peripheral edge thereof, a pair of remaining portions corresponding to said cut portion of said one electrode layer being displaced transversely from a remaining portion corresponding to said pair of cut portions of said other electrode layer.

38. A self-regulating heating article as claimed in claim 35, wherein a pair of said electrode layers and said resistive layer are cut off in a transverse direction at a displaced portion of said electrode layers.

39. A self-regulating heating article as claimed in claim 36, wherein a pair of said second layers and said first layer are cut off in a transverse direction at a displaced portion of said second layers.

40. A self-regulating heating article as claimed in claim 37, wherein a pair of said electrode layers and said resistive layer are cut off in a transverse direction at a displaced portion of said electrode layers.

41. A self-regulating heating article as claimed in claim 32, wherein each of said electrode layers has a portion connectable to a power supply, said portion of one of said electrode layers being displaced from the corresponding portion of the other electrode layer.

42. A self-regulating heating article as claimed in claim 36, wherein each of said electrode layers has a portion connectable to a power supply, said portion of one of said electrode layers being displaced from the corresponding portion of the other electrode layer.

43. A self-regulating heating article as claimed in claim 37, wherein each of said electrode layers has a portion connectable to a power supply, said portion of one of said electrode layers being displaced from the corresponding portion of the other electrode layer.

44. A self-regulating heating article as claimed in claim 31, wherein transversely extending peripheral edges of resistive layer and electrode layers are cut off from the inside to the outside in a longitudinal direction so as to be substantially inclined to boundary surfaces between said resistive and electrode layers.

45. A self-regulating heating article as claimed in claim 31, wherein each of said electrode layers has a portion connectable to a power supply, said portions being displaced from each other.

46. A self-regulating heating article as claimed in claim 31, wherein a transverse dimension of said electrode layers is larger than a transverse dimension of said resistive layer.

47. A self-regulating heating article as claimed in claim 31, further comprising a thermal diffusion layer in thermal transfer contact with a thin insulating layer which is attached to at least one of said electrode layers, said thermal diffusion layer having a transverse dimension greater than a transverse dimension of said electrode layer.

48. A self-regulating heating article as claimed in claim 31, further comprising an insulating layer enclosing said resistive layer and electrode layers.

49. A self-regulating heating article as claimed in claim 31, wherein said conductive particles include furnace black having a diameter of 40 micrometers or more.

50. A self-regulating heating article as claimed in claim 38, wherein each of said electrode layers has a thickness of 0.5 mm or less.

51. A method of manufacturing self-regulating heating article, comprising the steps of:

(a) forming a resistive compound into a thin elongate resistive compound, said resistive compound comprising mainly a mixture of a crystalline polymeric composition of high crystallinity and high breakdown voltage conductive particles having stability so that a commercial voltage may be applied in the direction of thickness of said thin elongate resistive compound, and dispersed in said crystalline polymeric composition, said resistive compound exhibiting a positive temperature coefficient of resistance;

(b) rolling successively said thin elongate resistive compound into a first thin elongate rolled resistive layer having a thickness of 1 mm or less;

(c) securing successively a pair of laminar metal electrodes on each surface of said first thin elongate rolled resistive layer; and (d) cutting off said first layer integral with said pair of electrodes at suitable intervals in a longitudinal direction such that an electric current flows in the direction of said first thin elongate rolled resistive layer, that a distance between said laminar metal electrodes is 1 mm or less at an effective exothermic portion of said first layer, that a creeping distance between said electrodes is more than 1 mm at longitudinally extending peripheral edge, that said first layer protrudes outwardly beyond said electrodes overlapped in the direction of thickness of said first layer along the entire peripheral edges of said first layer, that at least one of said electrodes is offset from a longitudinally extending peripheral edge of said first layer, that at least one of said electrodes is offset from an opposite longitudinally extending peripheral edge of said first layer and that said effective exothermic portion on which said electrodes are overlapped in the direction of thickness is covered with said electrodes.

52. A method according to claim 51, wherein an end face portion of at least one of longitudinally extending peripheral portions of said first layer is covered with an electrode.

53. A method according to claim 51, wherein an end face portion of at least one of longitudinally extending peripheral portions of each said electrodes is embedded in said first layer.

54. A method according to claim 52, wherein an end face portion of at least one of longitudinally extending peripheral portions of each said electrodes is embedded in said first layer.

55. A method according to claim 51, wherein said cutting step is performed so that at least one of transverse extending end portions of said electrodes is in the shape or in the position such that a portion of one of said electrodes is displaced from a portion of said other electrode.

56. A method according to claim 55, wherein one of said electrodes has a cut portion transversely extending form a longitudinal extending peripheral edge thereof and the other electrode has a cut portion transversely extending from a longitudinally extending peripheral edge which is opposite to said longitudinal extending peripheral edge of said one of said electrodes, a remaining portion corresponding to said cut portion of said one electrode being displaced transversely from a remaining portion corresponding to said cut portion of said other electrode.

57. A method according to claim 55, wherein one of said electrodes has a cut portion longitudinally extending from a central portion of a transverse extending peripheral edge thereof, and the other electrode has a pair of cut portions longitudinally extending from both end portions of said transversely extending peripheral edge thereof, a pair of remaining portions corresponding to said cut portion of said one electrode being displaced transversely from a remaining portion corresponding to said pair of cut portions of said other electrode.

58. A method according to claim 55, wherein a pair of said electrodes and said first layer are cut off in a transverse direction at a displaced portion of said electrodes.

59. A method according to claim 56, wherein a pair of said electrodes and said first layer are cut off in a transverse direction at a displaced portion of said electrodes.

60. A method according to claim 57, wherein a pair of said second layers and said first layer are cut off in a transverse direction at a displaced portion of said second layers.

61. A method according to claim 55, wherein each of said electrodes has a portion connectable to a power supply, said portion of one of said electrodes being displaced from the corresponding portion of the other electrode.

62. A method according to claim 56, wherein each of said electrodes has a portion connectable to a power supply, said portion of one of said electrodes being displaced from the corresponding portion of the other electrode.

63. A method according to claim 57, wherein each of said electrodes has a portion connectable to a power supply, said portion of one of said electrodes being displaced from the corresponding portion of the other electrode.

64. A method according to claim 52, wherein said cutting step is performed so that transversely extending peripheral edges of said first layer and electrodes are cut off from the inside to the outside in a longitudinal direction so as to be substantially inclined to boundary surfaces between said first layer and said electrodes.

65. A method according to claim 52, wherein said cutting step is performed so that each of said electrodes has a portion connectable to a power supply, said portions being displaced from each other.

66. A method according to claim 52, wherein said cutting step is performed so that a transverse dimension of said electrodes is larger than a transverse dimension of said first layer.

67. A method according to claim 52, wherein a thermal diffusion layer is in thermal transfer contact with a thin insulating layer which is attached to at least one of said electrodes, said thermal diffusion layer having a transverse dimension greater than a transverse dimension of said electrode.

68. A method according to claim 52, wherein an insulating layer encloses said first layer and electrodes.

69. A method according to claim 52, wherein said conductive particles include furnace black having a diameter of 40 micrometers or more.

70. A method according to claim 52, wherein each of said electrodes has a thickness of 0.5 mm or less.

* * * * *